US009039472B2

(12) United States Patent
Whitehead

(10) Patent No.: US 9,039,472 B2
(45) Date of Patent: May 26, 2015

(54) INTERLOCKING FLOATATION DEVICE

(71) Applicant: Clark James Whitehead, Santa Rosa, CA (US)

(72) Inventor: Clark James Whitehead, Santa Rosa, CA (US)

( * ) Notice: Subject to any disclaimer, the term of this patent is extended or adjusted under 35 U.S.C. 154(b) by 27 days.

(21) Appl. No.: 13/694,008

(22) Filed: Oct. 18, 2012

(65) Prior Publication Data

US 2014/0113515 A1 Apr. 24, 2014

(51) Int. Cl.

| | |
|---|---|
| ***B63C 9/08*** | (2006.01) |
| ***B63B 35/73*** | (2006.01) |
| ***B63B 21/00*** | (2006.01) |

(52) U.S. Cl.

CPC ..... *B63B 35/73* (2013.01); *B63B 21/00* (2013.01); *B63B 2021/003* (2013.01)

(58) Field of Classification Search

USPC ..... 441/74, 35; 114/77 R, 352
IPC ..... B63B 35/7906,35/7913, 35/7916
See application file for complete search history.

(56) References Cited

U.S. PATENT DOCUMENTS

| | | | | |
|---|---|---|---|---|
| 3,221,696 | A * | 12/1965 | Gardner | 114/266 |
| 5,381,747 | A * | 1/1995 | Hinde | 114/39.16 |
| 7,121,909 | B1 * | 10/2006 | Meyerhoffer | 441/74 |
| 7,390,234 | B2 * | 6/2008 | Peach | 441/74 |
| 7,503,820 | B2 * | 3/2009 | Cheung | 441/74 |
| 2005/0064773 | A1 * | 3/2005 | Arenson et al. | 441/74 |

* cited by examiner

*Primary Examiner* — Stephen Avila
(74) *Attorney, Agent, or Firm* — Risto A. Rinne, Jr.

(57) ABSTRACT

An apparatus for floatation of one or more persons on water includes a floatation device. The floatation device is sized for a single person and can be interlocked (i.e., secured) to additional floatation devices. Each individual floatation device is preferably made from an air-filled vinyl mattress or from foam. Each floatation device preferably includes at least one protrusion and at least one recess; however any desired combination of protrusions and recesses may be included. The protrusion of one individual floatation device interlocks within a recess of a second individual floatation device. A pair of retaining clips helps maintain each of the protrusions within the recesses. Any desired number of the individual floatation devices may be secured together to provide a larger overall floatation device for use by multiple persons while still providing each person their own personal floatation device.

13 Claims, 4 Drawing Sheets

INTERLOCKING FLOATATION DEVICE

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention, in general, relates to floatation devices and, more particularly, to a floatation device which can be secured to another floatation device to provide a larger floatation device.

Floatation devices are typically comprised of an inflatable piece of material or a type of foam floatation material that can be placed in water. They are useful in rescue efforts on water and, more commonly, for recreational activities.

The floatation device allows a person to essentially float on a device at the surface of water. In rescue efforts a person who may be inadvertently placed in water may stay afloat by use of a floatation device. Injured or otherwise incapacitated persons in water may be brought to safety by use of a floatation device administered by rescue personnel.

Most commonly, floatation devices are used to allow a person to float in a swimming pool, lake or river.

The floatation device can be reassuring to a swimmer who has yet to acquire sufficient swimming skills. Additionally, the floatation device affords a person the experience of being in a body of water without actually being immersed within the water. A person can relax and sunbathe atop the floatation device or socialize with others who are also on floatation devices.

Floatation devices are designed in many shapes, sizes and configurations to accommodate any number of people. However, the more people the floatation device is to accommodate inevitably also increases the size of the floatation device. This may not be ideal for all situations.

An inflated prior art floatation device designed for two or more persons may also be cumbersome and difficult to carry to the location of the water. Prior art floatation devices designed for two or more people, such as an inflatable boat or raft, can include a length that is longer than a person's height. Maneuverability of a large inflated prior art boat or raft is awkward and its size may deter usage due to its inability to be easily transported.

If a pump is not readily available at the desired time and location of where the prior art boat or raft is to be used, inflating such a large floatation device can be a difficult feat to accomplish. If a person tries to use their own breath to inflate the prior art boat or raft, it can be time consuming and exhausting.

Additionally, if a group of people are each using a single-person individually sized floatation device, such as a prior art inner or river tubes, it is difficult for the group to remain together due to currents and motion of the water beneath the prior art inner or river tube.

Yet, this is a common occurrence at swimming pools, ponds, lakes, and rivers. For example, a group of people may wish to float down a lazy river in unison so that they can converse and share the experience. However, this is not possible with currently available individually-sized floatation devices. And, as previously mentioned, the use of larger floatation devices, such as multiple person rafts or boats, are not practical due to size constraints and difficulty of inflation. Larger rafts are also expensive.

Accordingly, there exists today a need for an Interlocking Floatation Device that helps to ameliorate the above-mentioned problems and difficulties as well as ameliorate those additional problems and difficulties as may be recited in the "OBJECTS AND SUMMARY OF THE INVENTION" or discussed elsewhere in the specification or which may otherwise exist or occur and that are not specifically mentioned herein.

As various embodiments of the instant invention help provide a more elegant solution to the various problems and difficulties as mentioned herein, or which may otherwise exist or occur and are not specifically mentioned herein, and by a showing that a similar benefit is not available by mere reliance upon the teachings of relevant prior art, the instant invention attests to its novelty. Therefore, by helping to provide a more elegant solution to various needs, some of which may be long-standing in nature, the instant invention further attests that the elements thereof, in combination as claimed, cannot be obvious in light of the teachings of the prior art to a person of ordinary skill and creativity.

Clearly, such an apparatus would be useful and desirable.

2. Description of Prior Art

Floatation devices are, in general, known. Individual floatation devices that include the structural elements and advantages of the present invention are not known.

U.S. Design Pat. No. D658,257 to Whitehead, that issued on Apr. 24, 2012.

While the structural arrangements of the above described devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide an interlocking floatation device that is inflatable.

Another object of the invention is to provide an interlocking floatation device that provides floatation sufficient for a single person.

It is also an important object of the invention to provide an interlocking floatation device that can include a hollow interior.

Another object of the invention is to provide an interlocking floatation device that can be filled with air.

Still another object of the invention is to provide an interlocking floatation device that is made of rigid foam.

Still yet another object of the invention is to provide an interlocking floatation device that is made of soft foam.

Yet another important object of the invention is to provide an interlocking floatation device that includes vinyl.

Still yet another important object of the invention is to provide an interlocking floatation device that includes plastic.

A first continuing object of the invention is to provide an interlocking floatation device that can be secured to another interlocking floatation device.

A second continuing object of the invention is to provide an interlocking floatation device that can be secured to a plurality of other interlocking floatation devices.

A third continuing object of the invention is to provide an interlocking floatation device that includes at least one protrusion.

A fourth continuing object of the invention is to provide an interlocking floatation device that includes at least one recess.

A fifth continuing object of the invention is to provide an interlocking floatation device that includes at least one protrusion and to provide a second interlocking floatation device that includes at least one recess, and wherein the protrusion of the first interlocking floatation device fits into the recess of the second interlocking floatation device sufficient to retain the first interlocking floatation device proximate the second interlocking floatation device.

A sixth continuing object of the invention is to provide an interlocking floatation device that includes an overall square shape.

A seventh continuing object of the invention is to provide an interlocking floatation device that includes an overall rectangular shape.

An eighth continuing object of the invention is to provide an interlocking floatation device that can be cooperatively engaged with a plurality of other interlocking floatation devices to provide a multiple person floatation device.

A ninth continuing object of the invention is to provide an interlocking floatation device that can be used independently by one person.

A tenth continuing object of the invention is to provide an interlocking floatation device that includes a size and degree of floatation sufficient to accommodate an adult disposed on an upper surface thereof.

An eleventh continuing object of the invention is to provide an interlocking floatation device that includes a size and degree of floatation sufficient to accommodate a child disposed on an upper surface thereof.

A twelfth continuing object of the invention is to provide an interlocking floatation device that includes a first half of a pair of retaining clips that are located on opposite sides of a protrusion of the interlocking floatation device.

A thirteenth continuing object of the invention is to provide an interlocking floatation device that includes a second half of a pair of retaining clips that are located on opposite sides of a recess of the interlocking floatation device.

A fourteenth continuing object of the invention is to provide a first interlocking floatation device that includes a first half of a pair of retaining clips that are located on opposite sides of a protrusion of the interlocking floatation device and a second half of a pair of retaining clips that are located on opposite sides of a recess of a second interlocking floatation device, and wherein the first half of the pair of retaining clips is able to engage with a the second half of the pair of retaining clips sufficient to retain the first interlocking floatation device adjacent to the second interlocking floatation device.

Briefly, an interlocking floatation device that is constructed in accordance with the principles of the present invention preferably includes an air-filled vinyl mattress. Other materials suitable for the interlocking floatation device may include open-cell or closed-cell foams. The inflatable version of the interlocking floatation device includes a flexible covering surrounding a hollow interior that is inflatable. A valve is included on an outer surface of the flexible covering of the inflatable interlocking floatation device. The valve permits the interlocking floatation device to be filled with air from a pump or other means such as by blowing and deflating for transport. The interlocking floatation device includes at least one protrusion on a first side. At least one recess is included on an opposite second side. It is preferred that the interlocking floatation device also include a third side with another protrusion and a fourth side with another recess; however any desired combination of the protrusions and recesses may be included. Each of the interlocking floatation devices is individually-sized for a single person. The interlocking floatation device can include an overall size and degree of flotation for an adult or it can be sized for a child. The interlocking floatation device is able to be joined (i.e., secured) with one or more other interlocking floatation devices to create a larger floatation device for use by multiple persons. The protrusion of a first interlocking floatation device cooperatively engages with a recess of a second interlocking floatation device. The protrusion of the first interlocking floatation device is lifted above the recess of the second interlocking floatation device and is aligned with the recess of the second interlocking floatation device. The protrusion is then urged straight downward to engage within the recess thereby securing the first interlocking floatation device to the second interlocking floatation device. The individual floatation devices interlock with one-another much like a jigsaw puzzle. This action is repeated with any desired number of the interlocking floatation devices to create an overall size that is large enough to accommodate a desired number of persons simultaneously. A first half of a retaining clip is preferably provided proximate each side of the protrusions of each individual interlocking floatation device. A second half of the retaining clip is provided proximate each side of the recesses of the individual interlocking floatation device. The first half of the retaining clip includes a male connector. The second half of the retaining clip includes a female connector. If desired, the first half of the retaining clip could include the female connector and the second half of the retaining clip could include the male connector portion. After the protrusion of the first interlocking floatation device has been engaged (i.e., interlocked) with the recess of the second interlocking floatation device, the first halves of the retaining clips on the first interlocking floatation device are connected to the second halves of the retaining clips on the second interlocking floatation device. Once connected, the first and second halves of the retaining clips provide additional structural integrity to help maintain engagement of the protrusion of the first interlocking floatation device within the recess of the second interlocking floatation device. Once the plurality of interlocking floatation devices are interlocked and secured together using the retaining clips, multiple persons are able to float on their own individual interlocking floatation device yet remain proximate one-another.

DETAILED DESCRIPTION OF THE INVENTION

Figure 1:
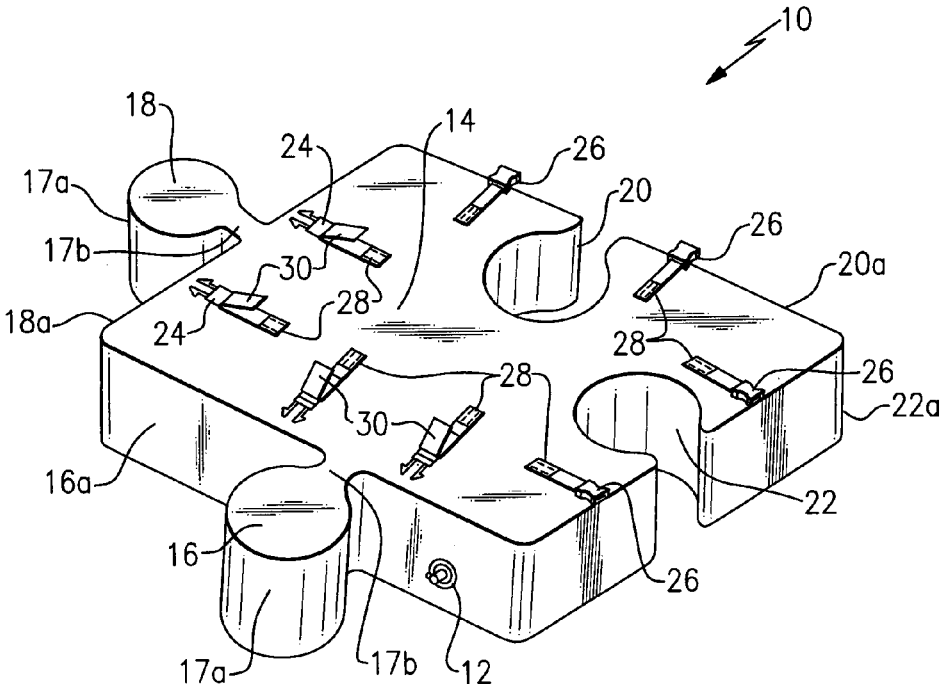
FIG. 1 is a view in perspective of an individual interlocking floatation device.

Referring on occasion to all of the FIGURE drawings and now, in particular to FIG. 1, is shown an interlocking floatation device, identified in general, by the reference numeral 10.

The reader will notice that reference is occasionally made throughout the DETAILED DESCRIPTION OF THE INVENTION suggesting that the reader refer to a particular drawing FIGURE. The suggestion is at times made when the introduction of a new element requires the reader to refer to a different drawing FIGURE than the one currently being viewed and also when the timely viewing of another drawing FIGURE is believed to significantly improve ease of reading or enhance understanding. To promote rapid understanding of the instant invention the reader is encouraged to periodically refer to and review each of the drawing FIGURES for possible cross-referencing of component parts and for other potentially useful information.

Certain examples are shown in the above-identified FIGURES and are described in greater detail below. In describing these examples, like or identical reference numerals may be used to identify common or similar elements.

The interlocking floatation device 10 is preferably made of an inflatable air-filled vinyl mattress. Any flexible material that is suitable for use with a conventional type of air mattress may be used for the inflatable version of the interlocking floatation device 10.

Other materials that may be used to provide a non-inflatable type of the interlocking floatation device 10 include a soft, open-cell foam or rigid closed-cell foam. In addition the interlocking floatation device 10 may be made of plastic.

A preferred overall shape for the interlocking floatation device 10 is square or rectangle; however any other desired shape is possible. In a preferred embodiment, the interlocking floatation device 10 resembles a giant square or rectangle jigsaw puzzle piece in appearance.

As shown in FIG. 1, a valve 12 is included where desired on an outer surface (i.e., flexible covering) of the inflatable version of the interlocking floatation device 10. The valve 12 may be included on any desired portion of the outer surface of the flexible vinyl covering comprising the interlocking floatation device 10. Should the interlocking floatation device 10 be made from open or closed-cell foam, or any other material that does not require inflation for buoyancy, the valve 12 is, of course, omitted.

The valve 12 permits air to fill a hollow interior (not shown) of the interlocking floatation device 10. Air supplied through the valve 12 may be from an air pump (not shown) or a person (not shown) may inflate the interlocking floatation device 10 by blowing directly into the valve 12 to supply the air. The valve 12 is also opened to permit deflation of the interlocking floatation device 10 for transportation.

The interlocking floatation device 10 is preferably sized large enough for an adult-sized person (not shown) to be fully supported on an upper surface 14, thereof. Additionally, the interlocking floatation device 10 may be available in a smaller size to support a child (not shown) on the upper surface 14 of the interlocking floatation device 10.

A first protrusion 16 is included on a first side 16*a* of the interlocking floatation device 10. A second protrusion 18 is optionally included on a second side 18*a* of the interlocking floatation device 10. The first and the second protrusions 16, 18 are preferably identical in size and shape. A preferred shape for the protrusions 16, 18 include a generally cylindrical portion 17*a* that is connected to a main body portion of the interlocking floatation device 10 by a thin neck 17*b* portion.

A first recess 20 is provided on a third side 20*a* of the interlocking floatation device 10. The first recess 20 is slightly larger than the first and second protrusions 16, 18. Therefore, the first recess 20 may cooperatively engage with either the first protrusion 16 or the second protrusion 18 of an additional (i.e., a second) interlocking floatation device 10 to help secure the two interlocking floatation devices 10 proximate one-another. Securement of a plurality of the interlocking floatation devices 10 is described in greater detail, hereinafter.

A second recess 22 is optionally provided on a fourth side 22*a* of the interlocking floatation device 10. The second recess 22 may cooperatively engage with either the first protrusion 16 or the second protrusion 18 of the second interlocking floatation device 10 depending on a preferred configuration of the plurality of interlocking floatation devices 10.

If desired, the child-sized version of the interlocking floatation device 10 may include identical sized first and second protrusions 16, 18 and first and second recesses 20, 22 as the adult-sized interlocking floatation device 10 to permit engagement with the adult-sized interlocking floatation device 10. This configuration provides the unexpected benefit of an adult being able to remain proximate a child while both are floating on their own individual interlocking floatation device 10 while in a swimming pool, lake, river, or pond.

An unexpected benefit is provided with either of the first or second recesses 20, 22. A person sitting atop the upper surface 14 of their own individual interlocking floatation device 10 may position their legs in between the space provided by the first or second recesses 20, 22 and submerge (i.e., dangle) their legs within the water. This benefit is especially convenient should a person wish to quickly cool themselves in the water while still being supported by a center portion of the upper surface 14 of the interlocking floatation device 10 when it is used by itself. This provides less tilting and greater stability than would otherwise occur if a person had to position themselves along the third or fourth sides 20*a*, 22*a*.

Another unexpected benefit provided by the first or second recesses 20, 22 is that a person wading in the water can position a portion of their upper torso in either of the recesses 20, 22. In this position, the person can extend their arms out over the upper surface 14 of the interlocking floatation device 10 to obtain additional floatation and great stability. This is useful for conversing simultaneously with people who are disposed on the upper surface 14 and in the water.

As shown, only the first protrusion 16 is provided on the first side 16*a*, and only the second protrusion 18 is provided on the second side 18*a*. It is possible to include two or more of both the first and second protrusions 16, 18 on each or any of the sides 16*a*, 18*a*, 20*a*, or 22*a*, as desired.

Similarly, as shown, only the first recess 20 is provided on the third side 20*a*, and only the second recess 22 is provided on the fourth side 22*a*. It is possible to include two or more of either the first and second recesses 20, 22 on each or any of the sides 16*a*, 18*a*, 20*a*, or 22*a* as desired to cooperate with the number of protrusions 16, 18 that are included.

Any desired combination of the first and second protrusions 16, 18 and the first and second recesses 20, 22 is possible for inclusion on any of the sides 16*a*, 18*a*, 20*a*, or 22*a*. This way any desired number of the interlocking floatation devices 10 may be secured to one-another to provide any desired overall size and configuration of multiple individual interlocking floatation devices 10.

Figure 2:
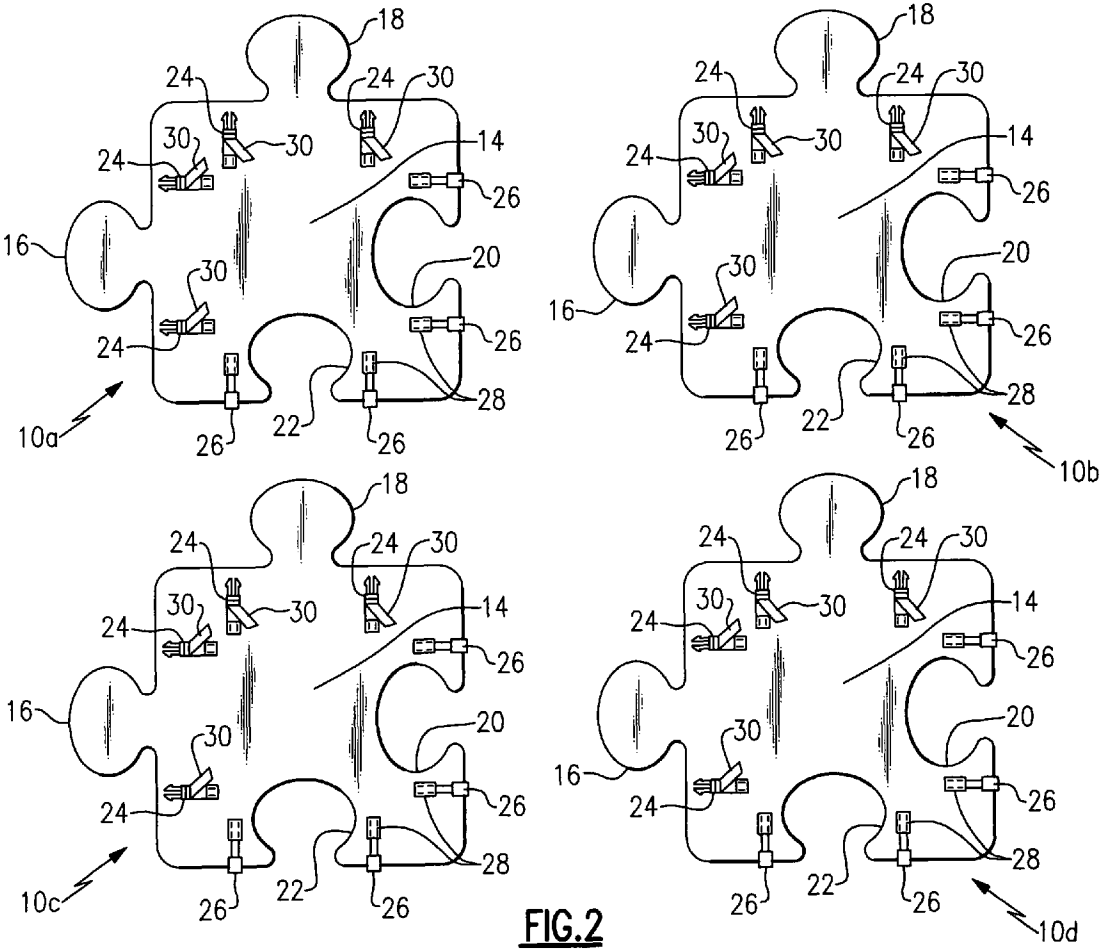
FIG. 2 is a top plan view of a plurality of interlocking floatation devices of FIG. 1 shown in a spaced-apart orientation.

Now referring to FIG. 2, a plurality of individual interlocking floatation devices 10 are shown in a spaced-apart orientation.

Four individual interlocking floatation devices 10 are shown, each identified in general by the respective reference numerals 10*a*, 10*b*, 10*c*, and 10*d*. For illustration purposes, only four of the interlocking floatation devices 10 are shown, however it is to be understood that any desired number of the interlocking floatation devices 10 may be secured to one another.

The first interlocking floatation device 10*a*, the second interlocking floatation device 10*b*, the third interlocking floatation device 10*c*, and the fourth interlocking floatation device 10*d* are preferably identical in shape, size, and design. However, it is to be further understood that the shape and amount of protrusions 16, 18 and recesses 20, 22 included on each individual interlocking floatation device 10 can vary, as desired.

The interlocking floatation device 10 can be used by a single person while floating in a swimming pool, lake, river or pond. The person is able to sit upon or lay across the upper surface 14 of the interlocking floatation device 10 while floating on water.

The interlocking floatation device 10 is preferably manufactured, packaged and sold as a single interlocking floatation device 10 designed for one person. Additional interlocking floatation devices 10 may be purchased separately and secured to one-another to permit multiple persons to each use their own interlocking floatation device 10 yet float in unison. If desired, a plurality of the interlocking floatation devices 10 can be packaged and sold together.

Once the first and second protrusions 16, 18 of one interlocking floatation device 10 are engaged within the first and second recesses 20, 22 of a second interlocking floatation device 10, an interlocking of the individual interlocking floatation devices 10*a*-10*d* is provided. (See also FIG. 3 and FIG. 4) Insertion of the first and second protrusions 16, 18 of the first interlocking floatation device 10*a* into the first and second recesses 20, 22 of the second interlocking floatation device 10*b* creates an interlock which resists motion and helps to retain the individual first, second, third, and fourth interlocking floatation device 10*a*-10*d* in place. As previously mentioned, it is to be understood that any desired number other than four individual interlocking floatation devices 10 may be secured to one-another. However, if a sufficiently strong force is applied to any of the joined interlocking floatation devices 10*a*-10*d* in a direction pulling them apart, the protrusions 16, 18 of the inflatable version may compress enough to be urged out of the recesses 20, 22 that it is disposed in. Similarly, if a sufficiently strong force in a direction pulling them apart is applied to any of the interlocking floatation devices 10*a*-10*d*, the protrusions 16, 18 of the foam version may be severed (i.e., broken) A solution is discussed below.

Figure 3:
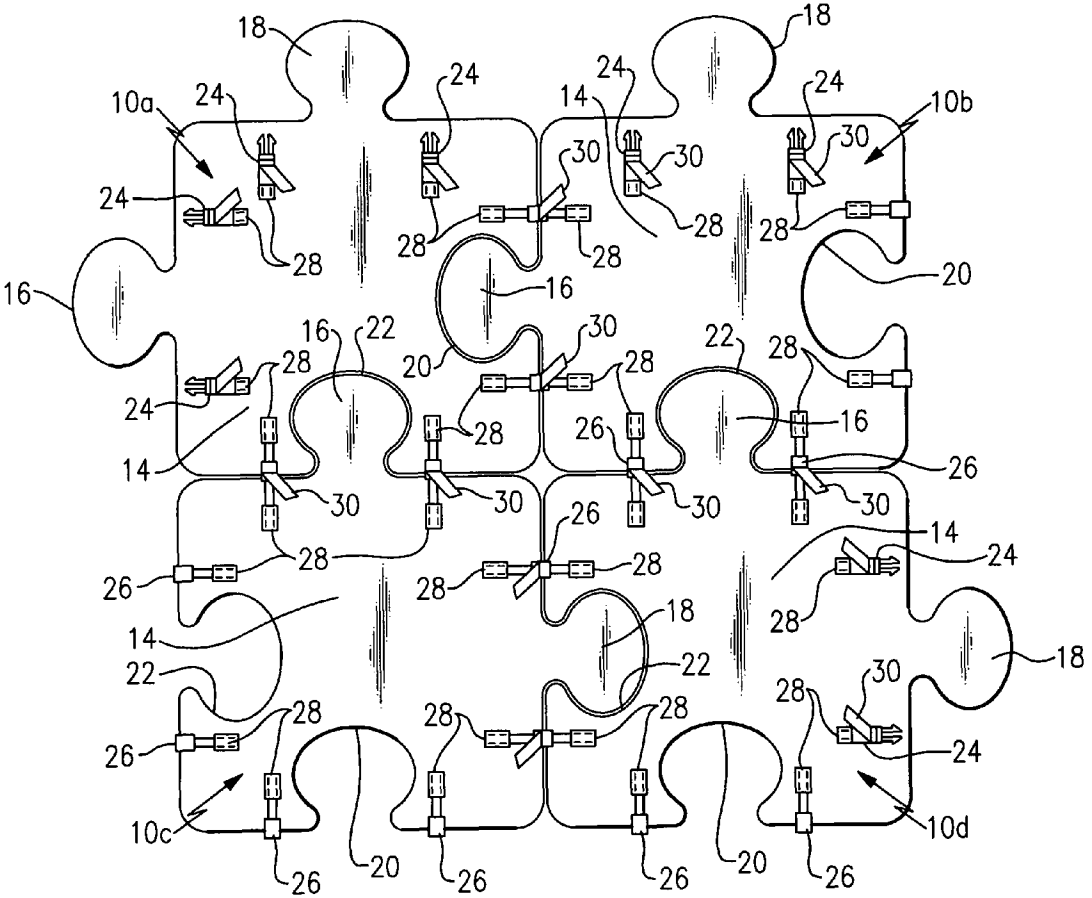
FIG. 3 is a top plan view of the plurality of interlocking floatation devices of FIG. 2 shown in an interlocked orientation.

Now referring to FIG. 3, is shown the first, second, third, and fourth interlocking floatation devices 10*a*-10*d* in a fully engaged (i.e., interlocked) position.

Depending on the desired configuration of the first, second, third, and fourth interlocking floatation devices 10*a*-10*d* determines which of the first and second protrusions 16, 18 of the first interlocking floatation device 10*a* is to be engaged with the respective first and second recesses 20, 22 of the remaining second, third or fourth interlocking floatation devices 10*b*-10*d*.

A preferred configuration of the four individual interlocking floatation devices 10*a*-10*d* is shown. Going in a clockwise motion to describe the preferred configuration, the first and second recesses 20, 22 of the first interlocking floatation device 10*a* have been cooperatively engaged with the first protrusion 16 of the second interlocking floatation device 10*b* and the first protrusion 16 of the third interlocking protrusion 10*c*. The second recess 22 of the second interlocking floatation device 10*b* has been cooperatively engaged with the first protrusion 16 of the fourth interlocking floatation device 10*d*. The second recess 22 of the fourth interlocking floatation device 10*d* has been cooperatively engaged with the second protrusion 18 of the third interlocking floatation device 10*c*.

The first protrusion 16 and the second protrusion 18 of the first interlocking floatation device 10*a*, the second protrusion 18 of the second interlocking floatation device 10*b*, the first recess 20 of the second interlocking floatation device 10*b*, the second protrusion 18 of the fourth interlocking floatation device 10*d*, the first recess 20 of the fourth interlocking floatation device 10*d*, and the first recess 20 and the second recess 22 of the third interlocking floatation device 10*c* are not used when the four interlocking floatation devices 10*a*-10*d* are joined together, as shown.

Each of the four individual interlocking floatation devices 10*a*-10*d* are joined together to form a contiguous unit of the first, second, third, and fourth individual interlocking floatation devices 10*a*-10*d*.

The joined configuration of the first, second, third, and fourth interlocking floatation device 10*a*-10*d* permits four people to have their own individual floatation device 10*a*-10*d* yet still remain proximate one-another, when desired.

To interlock each individual interlocking floatation device 10 to one-another, either the first or second protrusion 16, 18 of the first interlocking floatation device 10*a* is lifted above the desired first or second recess 20, 22 of the second, third or fourth interlocking floatation device 10*b*-10*d*. Either the first or second protrusion 16, 18 of the first interlocking floatation device 10*a* is aligned above the desired recess 20, 22 of the second, third, or fourth interlocking floatation device 10*b*-10*d* and urged downward to interlock within the first or second recess 20, 22. The first or second protrusion 16, 18 is pushed down into the desired first or second recess 20, 22 to align a bottom surface of each interlocking floatation device 10*a*-10*d* with the plane of the water beneath the interlocking floatation devices 10*a*-10*d*.

However, for the reasons discussed earlier, additional means for securing the individual interlocking floatation devices 10*a*-10*d* together is preferred.

A first half of a retaining clip 24 is included proximate the first protrusion 16 and the second protrusion 18 on opposite sides, thereof. A second half of a retaining clip 26 is included proximate the first recess 20 and the second recess 22 on opposite sides, thereof. The number of retaining clip halves 24, 26 is proportionally increased in pairs as more protrusions 16, 18 and recesses 20, 22 are included on the interlocking floatation device 10.

As shown, the first half of the retaining clip 24 includes a male connector. The male connector includes a pair of prongs that cooperatively engage with an open-end female connector included on the second half of the retaining clip 26. If desired, the male and female locations may be reversed.

Figure 4:
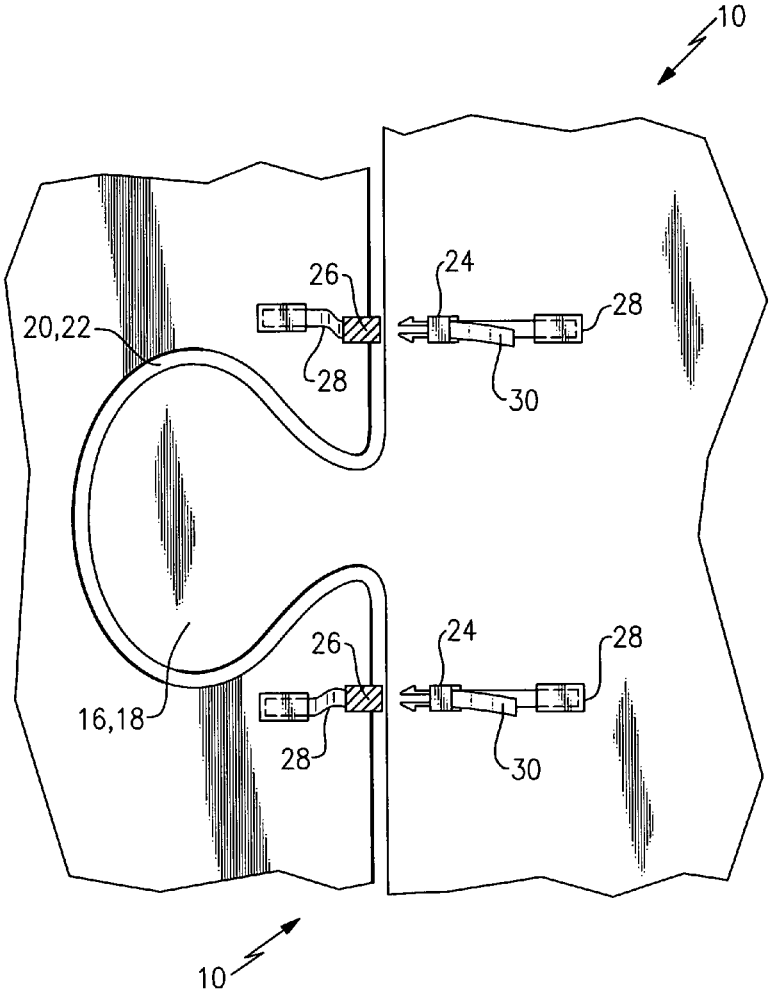
FIG. 4 is an enlarged partial view of two individual connected interlocking floatation devices of FIG. 1 prior to securement of a pair of retaining clips.

Now referring briefly to FIG. 4, an enlarged partial view of the first half of the retaining clip 24 and the second half of the retaining clip 26 is shown immediately prior to connection.

The first half of the retaining clip 24 and the second half of the retaining clip 26 each include a short flexible attachment strap 28 that is approximately several inches in length that secures the upper surface 14 of the first half of the retaining clip 24 and the upper surface 14 of the second half of the retaining clip 26 together. The flexible attachment strap 28 is preferably sewn or otherwise attached (i.e., molded) onto the material (i.e., vinyl, open or closed-cell foam, or plastic) comprising the upper surface 14 of the interlocking floatation device 10.

The flexible attachment strap 28 of the first half of the retaining clip 24 includes an adjustable-length strap 30. The adjustable-length strap 30 strengthens the connection between the first half of the retaining clip 24 and the second half of the retaining clip 26 by removal of any slack after connection.

Before connection of the first half of the retaining clip 24 with the second half of the retaining clip 26 occurs, the adjustable-length strap 30 is loosened to release tension being applied to the flexible attachment strap 28 of the first half of the retaining clip 24. After either the first or second protrusion 16, 18 of the first interlocking floatation device 10*a* have been interlocked within either the first or second recess 20, 22, of the second interlocking floatation device 10*b*, the prongs of the male connector of the first half of the retaining clip 24 are urged into the open-end of the female connector of the second half of the retaining clip 26.

To disconnect the first half of the retaining clip 24 from the second half of the retaining clip 26, the female connector is grasped and the prongs of the male connector are squeezed to release engagement within the open-end of the female connector. The male connector is then pulled out of the female connector.

The flexible attachment strap 28 permits movement of the female connector of the second half of the retaining clip 26 to ensure proper alignment and engagement with the male connector of the first half of the retaining clip 24.

Once the first half of the retaining clip 24 is cooperatively engaged (i.e., connected) to the second half of the retaining clip 26, the adjustable-length strap 30 is pulled upward to decrease slack of the flexible attachment strap 328 and to increase tension of the connection. The adjustable-length strap 30 is pulled until the desired tension of the flexible attachment strap 28 is achieved thereby securing either the first or second protrusion 16, 18 of one of the individual interlocking floatation devices 10*a*-10*d* proximate the first or second recess 20, 22 of another one of the individual interlocking floatation devices 10*a*-10*d*.

The location of the first half of the retaining clip 24 and the second half of the retaining clip 26 provides an unexpected benefit. Currents of the water from a lake, river or even in a swimming pool may try to pull the first and second protrusions 16, 18 away from the first and second recesses 20, 22. Movement of people may do the same. The tension provided by the adjustable-length strap 30 helps maintain the interlock of the first and second protrusions 16, 18 with the first and second recesses 20, 22.

Additionally, and as mentioned earlier, if the protrusions 16, 18 were made of the open or closed-cell foam, the currents of the water and forces that occur during use as people move about on the upper surface 14 of interlocking floatation devices 10*a*-10*d* could rip a portion of the foam material comprising the protrusions 16, 18, causing unwanted separation and damage to the interlocking floatation devices 10*a*-10*d*.

The first and second halves of the retaining clip 24, 26 secure the protrusions 16, 18 in place sufficient to lessen or prevent twisting and turning of the protrusions 16, 18 within the recesses 20, 22. Accordingly, the protrusions 16, 18 help maintain proper orientation with respect to each other of adjacent individual interlocking floatation devices 10*a*-10*d* during use.

Should any one person on their own individual interlocking floatation device 10, 10*a*-10*d* wish to no longer be floating in unison with the group of people, the person may detach the protrusions 16, 18 of their individual interlocking floatation device 10 that secure their interlocking floatation device 10 to any adjoining interlocking floatation device 10. Once detached, the person's individual interlocking floatation device 10 is separated from the interlocked unit of floatation devices 10*a*-10*d*. However, the remaining three individual interlocking floatation devices (any three of 10*a*-10*d*) of the group stay interlocked together.

Two means for securing any of the interlocking floatation devices 10, 10*a*-10*d* together have been described. Insertion of the protrusions 16, 18 into any of the recesses 20, 22 provides a first means of securing the interlocking floatation devices 10, 10*a*-10*d* together. Use of the first and second halves of the retaining clips 24, 26 provides a second means for securing the interlocking floatation devices 10, 10*a*-10*d* together.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. An interlocking floatation device, comprising:

(a) a substantially planar structure having a periphery and an upper, continuous surface, but for at least one connecting recess therein at the periphery of said structure, and being able to float on or proximate a surface of a body of water, wherein a plane of said substantially planar structure aligns with said surface, and wherein said periphery of said structure includes at least three sides, and wherein said at least three sides are each connected at opposite ends, thereof, to any of said at least three sides, and wherein said periphery fully encloses said structure;

(b) at least one protrusion disposed on said plane and which extends from said structure on at least two of said at least three sides;

(c) at least one connecting recess disposed on said plane and extending from the periphery of said structure on at least two of said at least three sides, wherein any of said protrusions of a first of said interlocking floatation devices is able to be disposed in any of said connecting recesses of a second of said interlocking floatation devices; and (d) means for securing said first interlocking floatation device proximate said second interlocking floatation device on either of said at least two of said three sides; wherein said means for securing includes a first half of a retaining clip disposed proximate said protrusion of said first of said interlocking floatation devices and a second half of a retaining clip disposed proximate said recess of said second of said interlocking floatation devices, wherein said first half of said retaining clip is able to engage with said second half of said retaining clip sufficient to secure said first of said interlocking floatation devices proximate said second of said interlocking floatation devices, and wherein said first half of said retaining clip includes a flexible attachment strap that is secured at a first end, thereof, to said first half of said retaining clip, and wherein a second end of said attachment strap is secured to said first of said interlocking floatation devices.

2. The interlocking floatation device of claim 1 wherein said means for securing includes said protrusion of said first of said interlocking floatation devices being disposed in said recess of said second of said interlocking floatation devices.

3. The interlocking floatation device of claim 1 wherein said second end of said attachment strap is secured to said upper surface of said first of said interlocking floatation devices.

4. The interlocking floatation device of claim 3 wherein said second end of said attachment strap is secured proximate said protrusion.

5. The interlocking floatation device of claim 1 wherein said second half of said retaining clip includes a flexible attachment strap that is secured at a first end, thereof to said second half of said retaining clip, and wherein a second end of said attachment strap is secured to said second of said interlocking floatation devices.

6. The interlocking floatation device of claim 5 wherein said second end of said attachment strap is secured to said upper surface of said second of said interlocking floatation devices.

7. The interlocking floatation device of claim 6 wherein said second end of said attachment strap is secured proximate said recess.

8. The interlocking floatation device of claim 1 wherein said first half of said retaining clip includes an adjustable length strap.

9. The interlocking floatation device of claim 1 wherein said structure includes a flexible covering and wherein said flexible covering includes an interior and wherein said interior is able to be inflated.

10. The interlocking floatation device of claim 9 wherein said structure includes a valve that can be opened to permit inflation or deflation of said interior and wherein said valve can be closed to retain said interlocking floatation device in an inflated state.

11. The interlocking floatation device of claim 1 wherein said structure includes an open cell foam.

12. The interlocking floatation device of claim 1 wherein said structure includes a closed cell foam.

13. The interlocking floatation device of claim 10 wherein said flexible covering includes a vinyl or other material that is sufficiently impervious to air to permit said interlocking floatation device to remain in said inflated state for a desired period of time.

* * * * *